United States Patent [19]

Palmieri et al.

[11] 4,069,514

[45] Jan. 24, 1978

[54] BELTLESS SLACKS

[76] Inventors: John Angelo Palmieri, 7764 B Penrose Ave., Elkins Park, Pa. 19117; Joseph Michael Palmieri, 261 Batleson Ave., Ambler, Pa. 19002

[21] Appl. No.: 750,799

[22] Filed: Dec. 15, 1976

[51] Int. Cl.[2] ..... A41D 1/06; A41F 9/00; A41D 27/20

[52] U.S. Cl. ..... 2/235; 2/236; 2/247

[58] Field of Search ..... 2/227, 236, 220, 235, 2/234, 219, 218, 247, 243 R

[56] References Cited

U.S. PATENT DOCUMENTS

| | | | |
|---|---|---|---|
| 749,605 | 1/1904 | Bieberstein | 2/235 |
| 2,347,354 | 4/1944 | Leubrie | 2/235 |
| 2,418,772 | 4/1947 | Jackson | 2/235 |
| 2,498,048 | 2/1950 | Neinken | 2/227 |
| 2,535,487 | 12/1950 | DiPietro | 2/234 |
| 2,680,851 | 6/1954 | Vallone | 2/235 X |
| 3,571,814 | 3/1971 | Miller | 2/236 |

FOREIGN PATENT DOCUMENTS

| | | | |
|---|---|---|---|
| 766,834 | 1/1957 | United Kingdom | 2/235 |
| 2,929 of | 1886 | United Kingdom | 2/235 |

*Primary Examiner*—H. Hampton Hunter
*Attorney, Agent, or Firm*—J. Rodman Steele, Jr.

[57] ABSTRACT

A pair of beltless trousers or slacks with a novel means of support, which permit the trousers or slacks to present a distinct and attractive appearance. A pair of trousers in accordance with the present invention relies upon neither belts, elastic or foam elastomer bands nor suspenders for support. Instead, the inner flap of the fly of the trousers or slacks is formed into a large, wide inner tab, tapering from a longer vertical side to a shorter vertical side. The shorter vertical side is detachably connected to the stiffening elements and the curtain liner on the inner wall of the left pocket, that is, the side of the waistband corresponding to the outer flap of the fly. This construction permits utilization of pockets which are connected solely to the curtain liner and stiffening elements, and which open to the top. All of the stitching used in the pocket construction and pocket attachment is non-visible from the outside of the trousers or slacks, except for the distinctive side seams of the trousers or slacks.

10 Claims, 6 Drawing Figures

FIG. 1
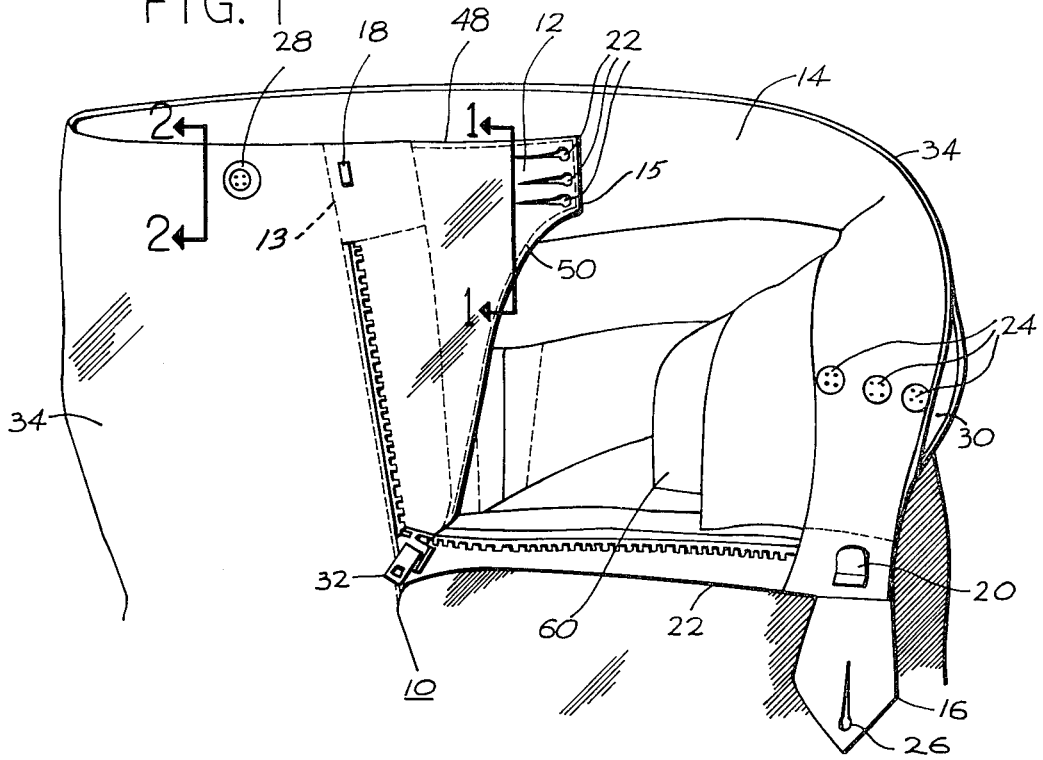
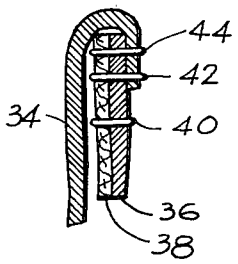
FIG. 3
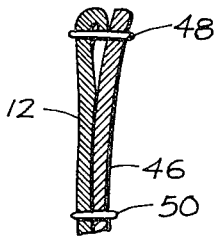
FIG. 2

FIG. 4
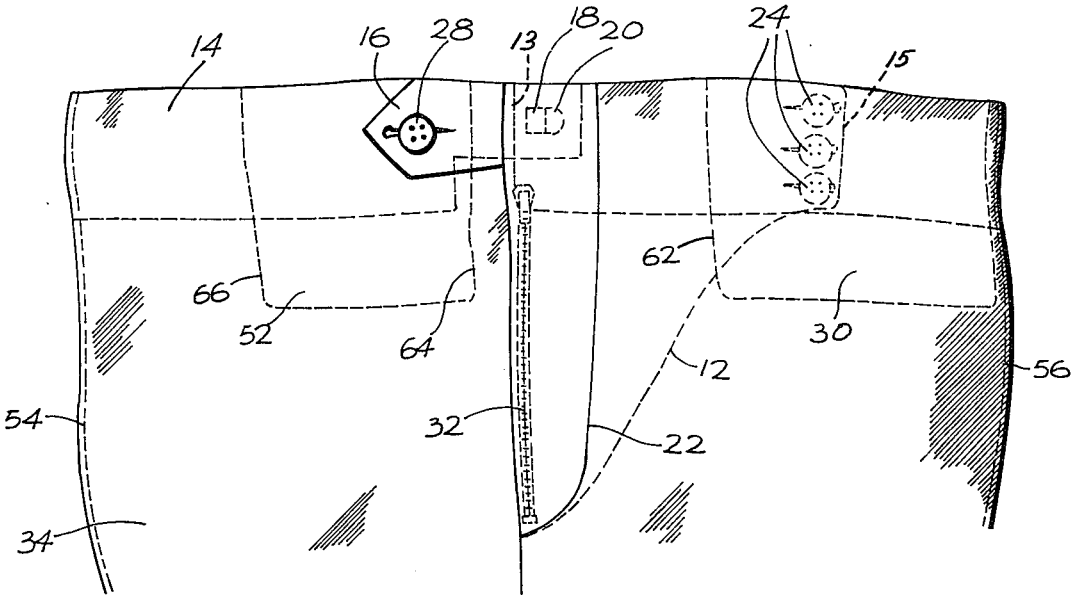
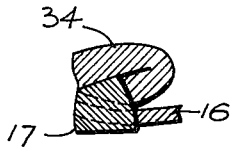
FIG. 6
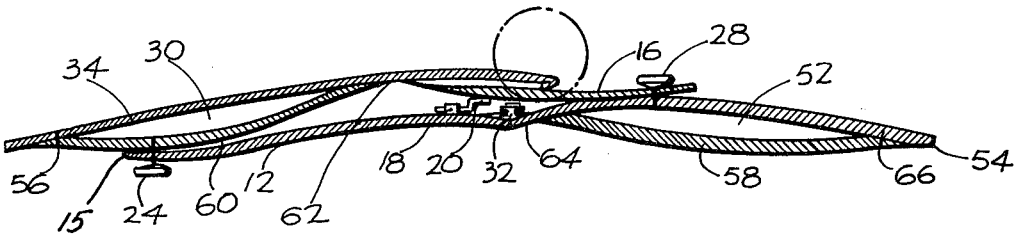
FIG. 5

BELTLESS SLACKS

BACKGROUND OF THE INVENTION

It has long been recognized that trousers or slacks require some additional means for support. These support means have included belts and suspenders, as well as special kinds of waistbands.

One well known type of special waistband is that which includes and relies upon elastic or rubber-like elements built into the waistband to contract same against the waist of the wearer. A second type of special waistband, illustrated by U.S. Pat. No. 3,221,346—Johnson et al., utilizes an inner strip of foam elastomer or similar material to provide additional frictional support.

Applicant has discovered a means for supporting trousers or slacks utilizing neither belts, suspenders, elastic members or other special waistband materials. By forming the inner flap of the fly of the trousers into a large, wide inner tab, tapering from a longer vertical side to a shorter vertical side, trousers or slacks may be thereby comfortably and reliably supported. The construction employed by applicant in attaching this inner tab and the stiffening elements results in a pair of trousers which present no visible circumferential stitching. Applicant's special construction also permits utilization of completely hidden pockets, opening at the top of the trousers.

The tapering of the large inner tab serves two purposes, maintaining the function of the fly and eliminating "give" in the waist region of the trousers or slacks while providing comfort when bending or sitting and for preventing accidental seam ruptures.

BRIEF SUMMARY OF THE INVENTION

It is an object of the present invention to provide a pair of trousers or slacks which do not rely on belts, elastic bands or suspenders for support.

It is another object of the present invention to provide a pair of trousers or slacks which present a unique appearance.

It is yet another object of the present invention to provide a pair of trousers or slacks which have no visible circumferential stitching in the waist region thereof.

It is yet a further object of the present invention to provide a pair of trousers or slacks with non-visible pockets.

It is a still further object of the present invention to provide a pair of beltless trousers which present a unique appearance by utilization of non-visible pockets and the absence of visible circumferential stitching in the waist region of said trousers.

In brief, the present invention is a pair of trousers or slacks with a novel means of support, which permit the trousers to further present a distinct and attractive appearance as well. A pair of trousers in accordance with the present invention rely upon neither belts, elastic bands nor suspenders for support. Instead, the inner flap of the fly of the trousers is formed into a large, wide inner tap, tapering from a longer vertical side to a shorter vertical side. The shorter vertical side is detachably connected to the stiffening elements of the curtain liner on the inner wall of the left pocket. In the preferred embodiment, this large inner tab is at least as wide as half the length of the opening of the fly.

The stiffening elements of the curtain forming an internal waistband liner are attached to the inside of the waist region of the trousers or slacks with no visible circumferential stitching. At the single circumferential seam at which the trouser or slack material and the stiffening elements of the curtain liner are attached the latter are folded to be inside the waistband of the trousers or slacks and therefore not visible. The distinctive appearance of the trousers or slacks is further enhanced by utilizing pockets which are connected solely to the curtain liner, and which open to the top. All of the stitching used in the pocket construction and pocket attachment is not visible from the outside of the trousers or slacks except for the distinctive side seams of the trousers or slacks. A small outer tab is used to further secure the upper section of the outer flap of the fly to the trouser or slack material. As with the larger inner tab, the smaller outer tab is detachably connected by means of buttons, snaps or other suitable detachable connectors.

The tapering of the large inner tab serves two purposes. One purpose is to maintain the function of the fly. The second is to eliminate "give" in the waist region of the trousers or slacks while providing both comfort when bending or sitting and for preventing accidental seam ruptures.

A pair of trousers or slacks in accordance with the present invention are comfortably and integrally supported, without the necessity of elastic waistbands or waistband sections, and has no visible pockets or circumferential stitching to mar the distinctive appearance of the visible vertical stitching.

BRIEF DESCRIPTION OF THE DRAWINGS

For the purposes of illustrating the invention, there are shown in the drawings forms which are presently preferred; it being understood, however, that this invention is not limited to the precise arrangements and instrumentalities shown.

FIG. 1 is a partially folded-open, front-view of a pair of beltless slacks according to the present invention;

FIG. 2 is a section-view along the line 1—1 of FIG. 1;

FIG. 3 is a section-view along the line 2—2 of FIG. 1;

FIG. 4 is a front-view according to the present invention;

FIG. 5 is a top-view of the front half of the waist area of a pair of beltless slacks according to the present invention; and FIG. 6 is an enlarged view of the outer tab connection shown in the circled portion of FIG. 5.

DETAILED DESCRIPTION OF THE PREFERRED EMBODIMENT

The upper waist region 10 is a pair of beltless trousers or slacks according to the present invention is shown in FIG. 1. Trousers or slacks constructed according to the present invention have no visible circumferential stitching in the waist area 10. FIG. 3 shows the basic construction which permits all circumferential stitching to remain non-visible. A first stiffening band 36 which can be made of plastic or synthetic material, and a second stiffening band 38 which can be canvas or buckram, are first connected to one another with stiffener-stiffener stitching 40. Stiffening bands 36 and 38 are then connected to the slack fabric 34 with stiffener-fabric stitching 42 and 44. For purposes of clarification, curtain liner 14 is omitted from FIG. 3. After the stiffening bands have been sewn to the slack fabric 34, they are folded over, so as to form an internal waistband and at the same time be hidden by the slack fabric 34 itself. The curtain liner 14, the left pocket 30, the right pocket 52 and the outer tab 16 are all connected to the stiffening bands 36 and 38, thereby eliminating all visible circumferential stitching.

The pair of trousers in accordance with the present invention, rely upon neither belts, elastic or foam elastomer bands nor suspenders. Instead, the inner flap of the fly of the trousers is formed into a large, wide inner tab 12, tapering from a longer vertical side, located approximately along the line of seam 13, to a shorter vertical side, being approximately from ¼ to ½ the length of the longer vertical side. The shorter vertical side, denoted along its edge by numeral 15, is detachably connected to the stiffening elements 36 and 38 of the curtain liner 14 on the inner wall 60 of left pocket 30. In the presently preferred embodiment, this large inner tab 12 is at least as wide as half the length of the fly or the longer vertical side. The use of wide inner tab 12 has been found to obviate the need for providing any additional support for the slacks, in any form.

The tapering of the large inner tab 12 serves two purposes. One purpose is to maintain the function of the fly. The second purpose is to eliminate "give" in the waist region 10 of the trousers while providing both comfort when bending or sitting and for preventing accidental seam ruptures.

The distinctive appearance of the trousers 10 is further enhanced by utilizing pockets 30 and 52 which are connected solely to the stiffening bands 36 and 38 and the curtain 14, and which open to the top. A small outer tab 16 is used to further secure the upper section of the outer flap of the fly 22 to the slack fabric 34.

The inner tab 12 has three inner tab button holes 22, which are engageable with three inner tab buttons 24 which are secured to stiffening elements of the inner wall 60 of the left pocket 30. The outer tab 16 has an outer tab button hole 26 which is detachably engageable by outer tab button 28. A zipper 32 and a clip 18 and a corresponding clip hook 20 are further provided for closing the inner tab 16 and an outer flap of fly 22. It will be appreciated that inner tab 12 and outer tab 16 may be detachably connected by snaps or other suitable means. The zipper 32 can be replaced by snaps, buttons or other suitable means as well.

The inner tab 12 is lined with inner tab curtain 46, attached thereto by peripheral stitching having an upper horizontal row 48 and a vertical row 50, as shown in FIG. 2. The rows of stitching 48 and 50 are not visible when the slacks are secured as explained above.

As shown in FIG. 5, the inner and outer walls of pockets 30 and 52 are hidden by the visible slack fabric 34. The inner wall 60 of the left pocket 30 is connected to the stiffening elements 36 and 38, behind the slack fabric 34 with a non-visible seam 62 and a visible seam 56. Seam 56 is the left side seam of the slack, extending from the top of the waist to the bottom of the pants legs. The inner wall 58 of the right pocket 52 is secured by non-visible seam 64 and by non-visible seam 66, which are attached to stiffening bands 36 and 38, although the seams, on only the pocket itself, may extend with the pocket below the stiffening bands, as shown in FIG. 4. The pocket hanging on and extending below the stiffening bands is also shown in the folded out section of FIG. 1. Seam 54, the left side seams of the slacks, also extends from the top of the waist to the bottom of the pants leg, and may be used as an alternate connecting seam for right pocket 52, if desired. Either pocket may be attached by either method.

The connection of outer tab 16 is more fully detailed in FIG. 6. Slack fabric 34 is folded back on itself. A piece of material 17 is attached in the fold, and is itself folded inwardly, covering one end of outer tab 16, which terminates therein. Material 17 may be the same as slack material 34.

The present invention may be embodied in other specific forms without departing from the spirit or essential attributes thereof, and, accordingly, reference should be made to the appended claims, rather than the foregoing specifications as indicating the scope of the invention.

I claim:

1. A pair of beltless trousers, having a waist region and fly opening in the front of said waist region, said fly opening having an inner and an outer flap, comprising:

a stiffening element attached to the upper inside edge of said waist region without visible circumferential stitching, said stiffening element having overlapping edges at said fly opening, and said stiffening element obviating the need for a conventional waistband having visible circumferential stitching;

a large, wide inner tab, tapering from a longer vertical side to a shorter vertical side, the length of said shorter vertical side being from ¼ to ½ the length of said longer vertical side, for securing said trousers about the hips of a user; said longer vertical side of said inner tab forming the inner flap of said fly opening; and, a first means for detachably connecting said shorter vertical side of said inner tab to said stiffening element on the side of said waistband corresponding to the outer flap of said fly opening, said first connecting means providing essentially continuous vertical attachment.

2. A pair of trousers of claim 1, wherein said inner tab is at least as wide as ½ the length of said longer vertical side.

3. The pair of trousers of claim 1, further comprising at least one pocket supported by stitching connected only to to said stiffening element inside said trousers, said at least one pocket opening at its top, adjacent the upper edge of said waist region, thereby being concealed from view.

4. The pair of trousers of claim 1, further comprising:

a small outer tab, connected at one edge thereof to the uppermost part of said outer flap of said fly opening through a fold in said outer flap, with only one visible vertical seam; and a second means for detachably connecting said outer tab to the outside of the trousers, on the side corresponding to said inner flap of said fly opening.

5. The pair of trousers of claim 1, wherein said first connecting means are at least three buttons and corresponding buttonholes mounted at spaced vertical intervals.

6. The pair of trousers of claim 4, wherein said second connecting means is at least one button and buttonhole.

7. A method for constructing a pair of beltless trousers having no visible circumferential stitching in the material forming the waist region thereof, comprising the steps of:

stitching at least one stiffening element to the inside upper edge of said material, co-extensive in length with said upper edge resulting in the overlap of the two ends of the at least one stiffening element, when the trousers are worn;

folding said at least one stiffening element inside of said material, such that said stitching is covered by said material when viewed from the outside of said trousers, said at least one stiffening element obviating the need for a conventional internal waistband with visible circumferential stitching;

attaching top-opening pockets inside the front of said waist region utilizing stitching sewn only to said at least one stiffening element;

constructing a fly opening having an inner and an outer flap in the front of said waist region;

forming said inner flap into a large wide tab, tapering from a longer vertical side to a shorter vertical side; and mounting on said shorter vertical side of said inner tab and on said at least one stiffening element essentially continuous means for detachably connecting said inner tab to said at least one stiffening element, thereby enabling said trousers to be comfortably and securely supported when worn.

8. The method of claim 7, wherein the length of said shorter vertical side of said inner tab is from ¼ to ½ the length of said fly and the width of said inner tab is at least as wide as ½ the length of said fly.

9. The method of claim 7, wherein said detachable connection means are at least three buttons and corresponding buttonholes mounted at spaced vertical intervals.

10. The method of claim 7 further comprising the step of securing a small outer tab to the outer flap of said fly through a fold in said outer flap, for additionally maintaining said fly in a closed position.

* * * * *